US009879456B1

(12) United States Patent
Chen

(10) Patent No.: US 9,879,456 B1
(45) Date of Patent: Jan. 30, 2018

(54) HINGE DEVICE

(71) Applicants: Waterson Corp., Taichung (TW); Waterson Chen, Taichung (TW); Yin-Chu Chen, Taichung (TW)

(72) Inventor: Waterson Chen, Taichung (TW)

(73) Assignees: Waterson Corp., Taichung (TW); Waterson Chen, Taichung (TW); Yin-Chu Chen, Taichung (TW)

( * ) Notice: Subject to any disclaimer, the term of this patent is extended or adjusted under 35 U.S.C. 154(b) by 0 days.

(21) Appl. No.: 15/597,706

(22) Filed: May 17, 2017

(30) Foreign Application Priority Data

Feb. 15, 2017 (TW) ..... 106104849 A

(51) Int. Cl.
*E05D 11/00* (2006.01)
*E05D 5/02* (2006.01)
*E05D 3/02* (2006.01)

(52) U.S. Cl.
CPC ..... *E05D 11/00* (2013.01); *E05D 3/02* (2013.01); *E05D 5/0246* (2013.01); *E05Y 2900/132* (2013.01); *Y10T 16/534* (2015.01)

(58) Field of Classification Search
CPC ... Y10T 16/534; Y10T 16/554; Y10T 16/558; E05D 11/00; E05D 3/02; E05D 5/0246; E05Y 2900/132; A47K 3/36; A47K 3/28; A47K 2003/367
USPC ..... 16/252, 382, 387
See application file for complete search history.

(56) References Cited

U.S. PATENT DOCUMENTS 5,867,869 A * 2/1999 Garrett ..... A47K 3/36 16/252
6,070,294 A * 6/2000 Perkins ..... A47K 3/36 16/250
6,481,055 B2 * 11/2002 Cheng ..... E05D 5/0246 16/250
6,560,821 B2 * 5/2003 Miller ..... E05D 5/0246 16/252
6,704,966 B1 * 3/2004 Kao ..... E05D 5/0246 16/252
6,766,561 B1 * 7/2004 Cheng ..... E05D 5/0246 16/235
7,188,390 B2 * 3/2007 Cheng ..... E05D 5/0246 16/235
7,493,673 B2 * 2/2009 Garrett ..... E05D 5/0246 16/252
7,594,302 B2 * 9/2009 Balenzano ..... E05D 5/0246 16/252
7,814,616 B2 * 10/2010 Garrett ..... E05D 5/128 16/252

(Continued)

*Primary Examiner* — William L Miller
(74) *Attorney, Agent, or Firm* — Trop Pruner & Hu, P.C.

(57) ABSTRACT

A hinge device includes a hinge and a clamping unit. The hinge includes a first leaf mounted on a first object, and a second leaf pivotably connected to the first leaf. The clamping unit includes bracing and pressure plates spaced apart from each other by a clamping space for accommodating a second object. The bracing plate is removably attached to the second leaf such that the second leaf can be shifted in two mounting positions, one where the bracing plate is removed from the second leaf and the second leaf is connected to the second object, and one where the bracing plate is attached to the second leaf and the second object is clamped by the bracing and pressure plates.

9 Claims, 11 Drawing Sheets

(56) References Cited

U.S. PATENT DOCUMENTS

| | | | | |
|---|---|---|---|---|
| 7,900,319 | B2 * | 3/2011 | Bacchetti | E05D 5/0246 16/252 |
| 7,917,994 | B2 * | 4/2011 | Bai | E05D 11/105 16/252 |
| 8,539,643 | B2 * | 9/2013 | Hung | E05F 3/12 16/252 |
| 2011/0099755 | A1 * | 5/2011 | Reichel | E05D 5/0246 16/251 |

* cited by examiner

HINGE DEVICE

CROSS-REFERENCE TO RELATED APPLICATION

This application claims priority of Taiwanese Patent Application No. 106104849, filed on Feb. 15, 2017.

FIELD

The disclosure relates to a hinge device, and more particularly to a hinge device adapted to be mounted on a variety of objects.

BACKGROUND

A hinge is for connecting a door frame and a door wing to allow rotation relative to each other about a fixed axis. A variety of conventional hinges have been developed for applications to doors of different dimensions, functions, etc., and to doors made of different materials. For example, it is required in the United States to mount three hinges on a door. Different hinges and different assembly procedures are employed for different types of doors.

Referring to FIG. 1, for a wood-made door, a conventional hinge 11 includes a first leaf 111 mounted on a side wall 121 of a door frame 12, and a second leaf 112 mounted on a minor wall 131 of a wood-made door 13 and pivotably connected to the first leaf 111 to be rotatable between open and closing positions. The wood-made door 13 generally has a plurality of recesses each formed in the minor wall 131 for embedding the second leaf 112, or is provided with reinforced plates (not shown) each for engaging the second leaf 112.

Referring to FIGS. 2 and 3, for a glass door, a conventional hinge 21 as disclosed in Taiwanese Utility Model M321935 includes two leaves 211, 212 pivotably connected to each other, and a clamping plate 213 spaced apart from the leaf 212 to clamp a glass door 22.

Those hinges 11, 21 are only suitable for certain doors, and cannot be applied to different types of doors. In other words, when a glass door 22 is required to be replaced by a wood-made door, a hinge 21 thereon must be replaced by a hinge 11, which renders the assembly costly and time-consuming, and the application of the hinges 11, 21 is limited.

SUMMARY

Therefore, an object of the disclosure is to provide a hinge device that can alleviate at least one of the drawbacks of the prior art.

According to the disclosure, the hinge device is provided to interconnect a first object and a second object to allow rotation relative to each other, and includes a hinge and a clamping unit. The hinge includes a first leaf which is adapted to be mounted on the first object, and a second leaf which is pivotably connected to the first leaf about an axis and which is adapted to be mounted on the second object when the second leaf is in a first mounting position. The first leaf and the second leaf respectively have included surfaces which respectively define extending lines that meet at the axis to have therebetween a first angle ranging from 0 degree to 180 degrees, and attaching surfaces which are disposed opposite to the included surfaces, respectively, and remote from each other. The clamping unit includes a bracing plate and a pressure plate which are spaced apart from each other by a clamping space for accommodating the second object when the second leaf is in a second mounting position. The bracing plate is removably connected to the second leaf, and has an attached surface which is configured to be attached to the attaching surface of the second leaf, and a bracing surface which faces the clamping space. The attached surface and the bracing surface respectively define extending lines that meet at the attached surface to have therebetween a fixed second angle.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
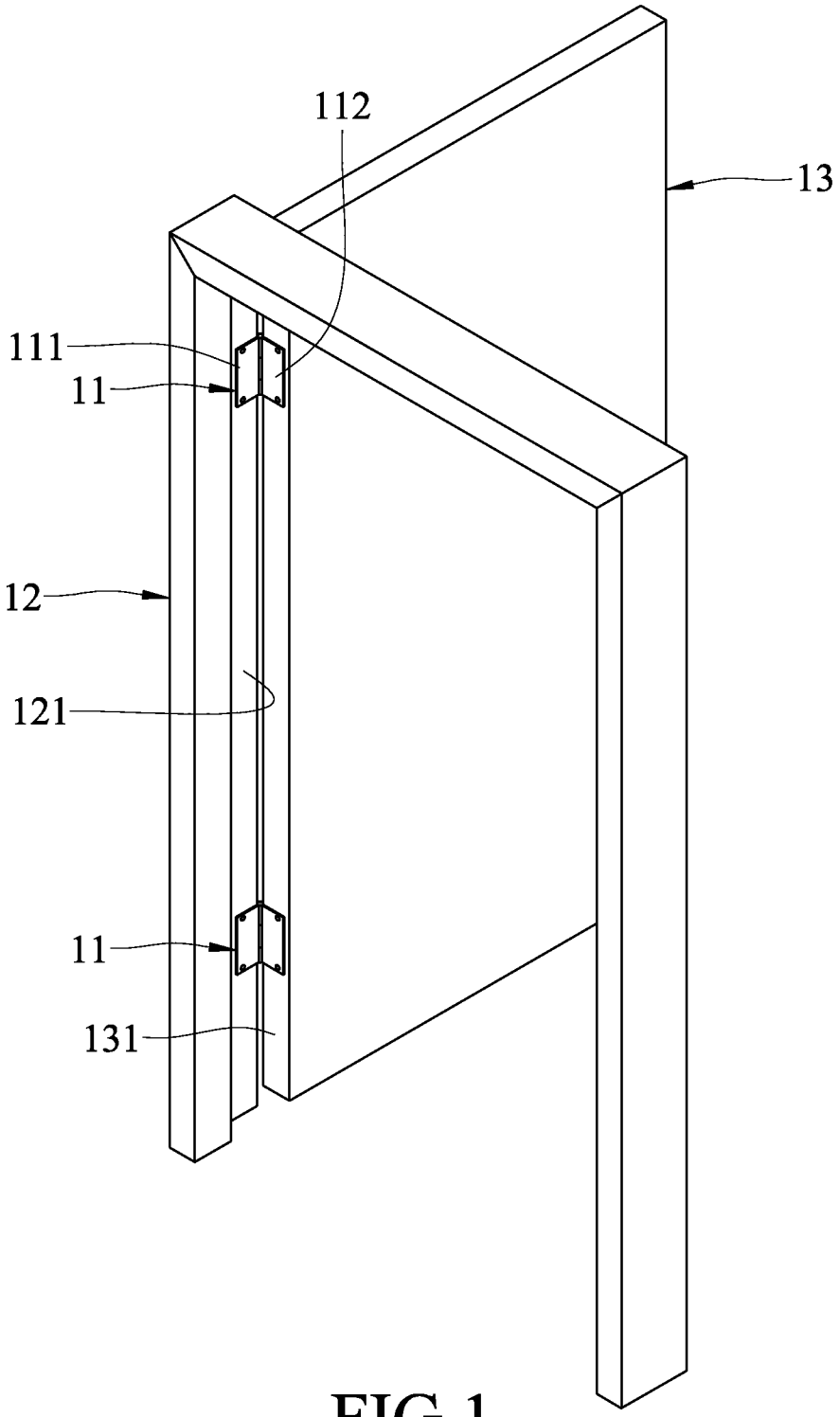
FIG.1 PRIOR ART
FIG. 1 is a perspective view of a conventional hinge mounted on a door.
Figure 2:
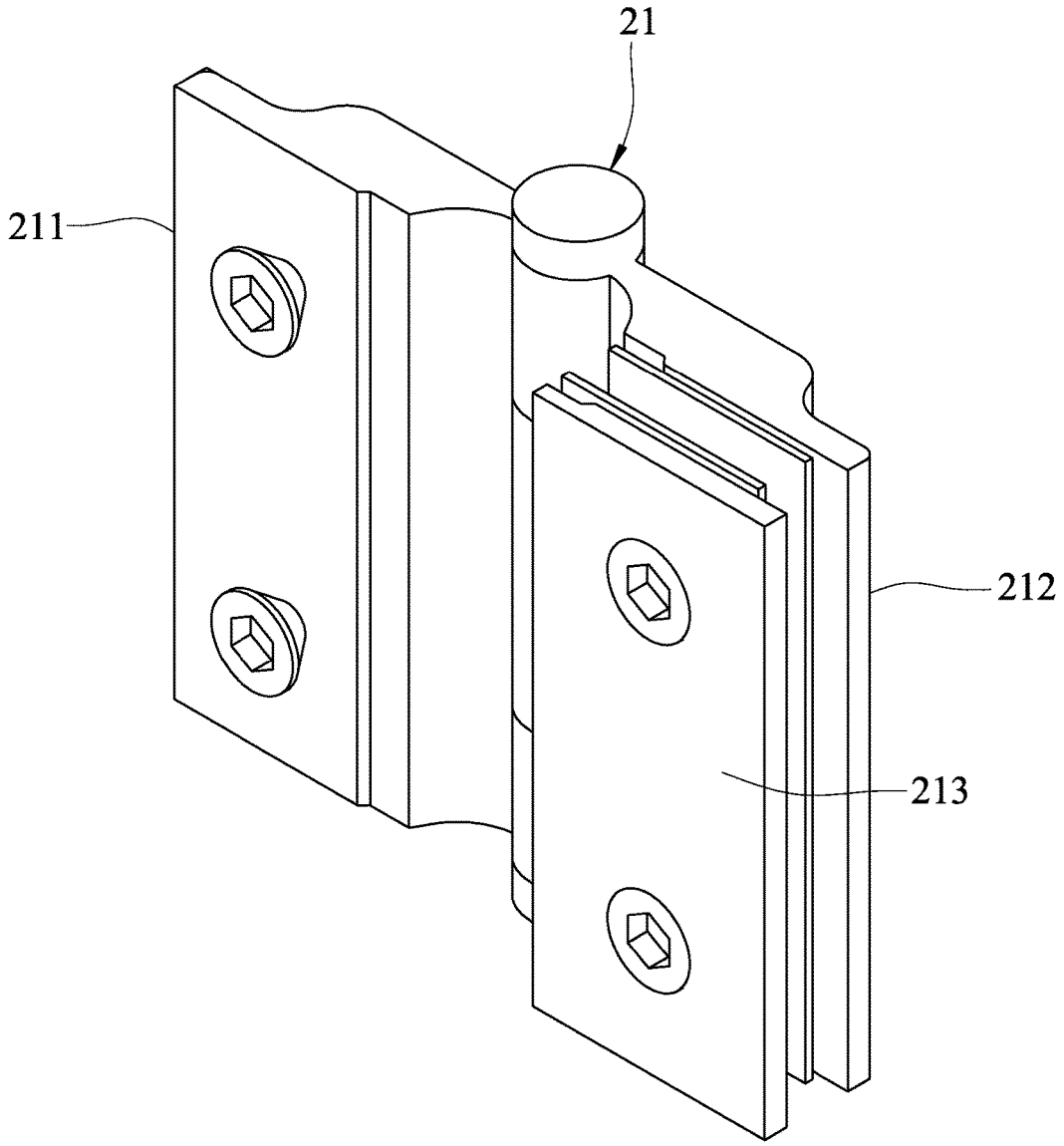
FIG.2 PRIOR ART
FIG. 2 is a perspective view of another conventional hinge.
Figure 3:
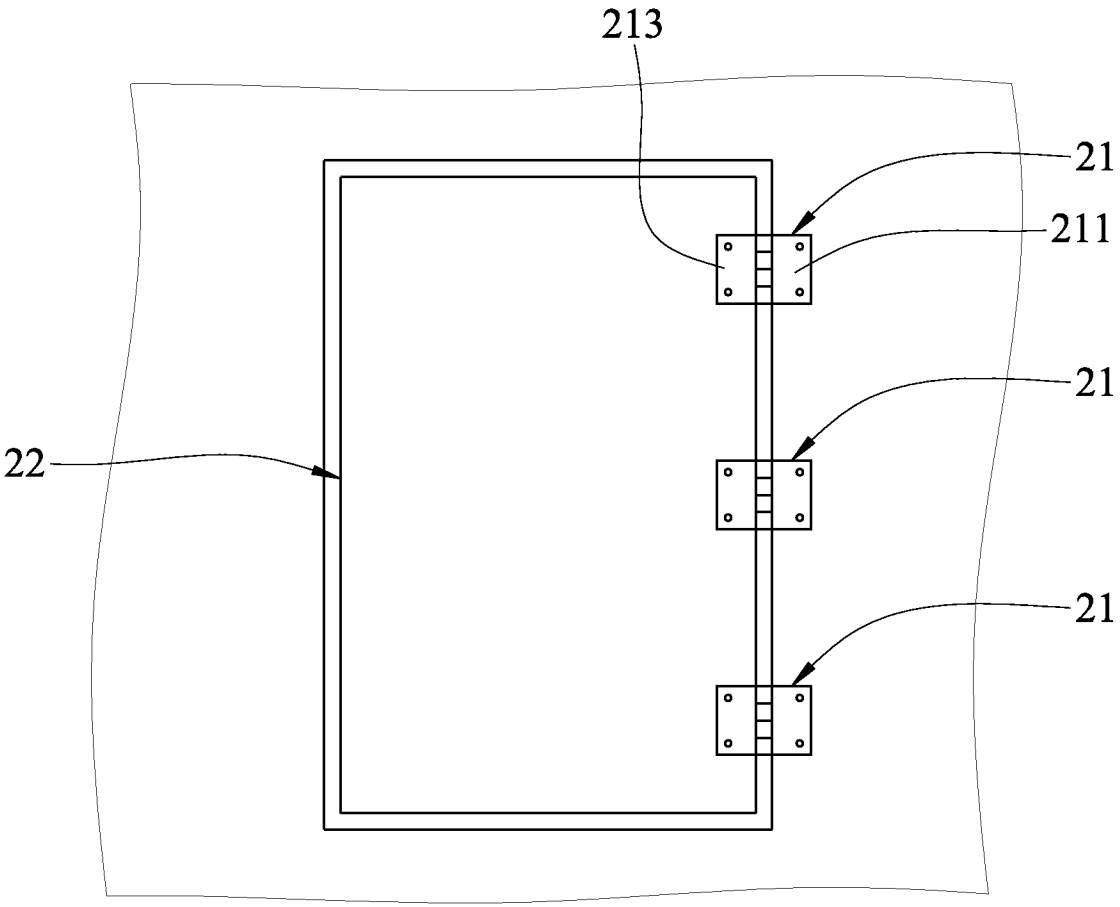
FIG.3 PRIOR ART
FIG. 3 is a schematic view illustrating the hinge in FIG. 2 mounted on a glass door.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
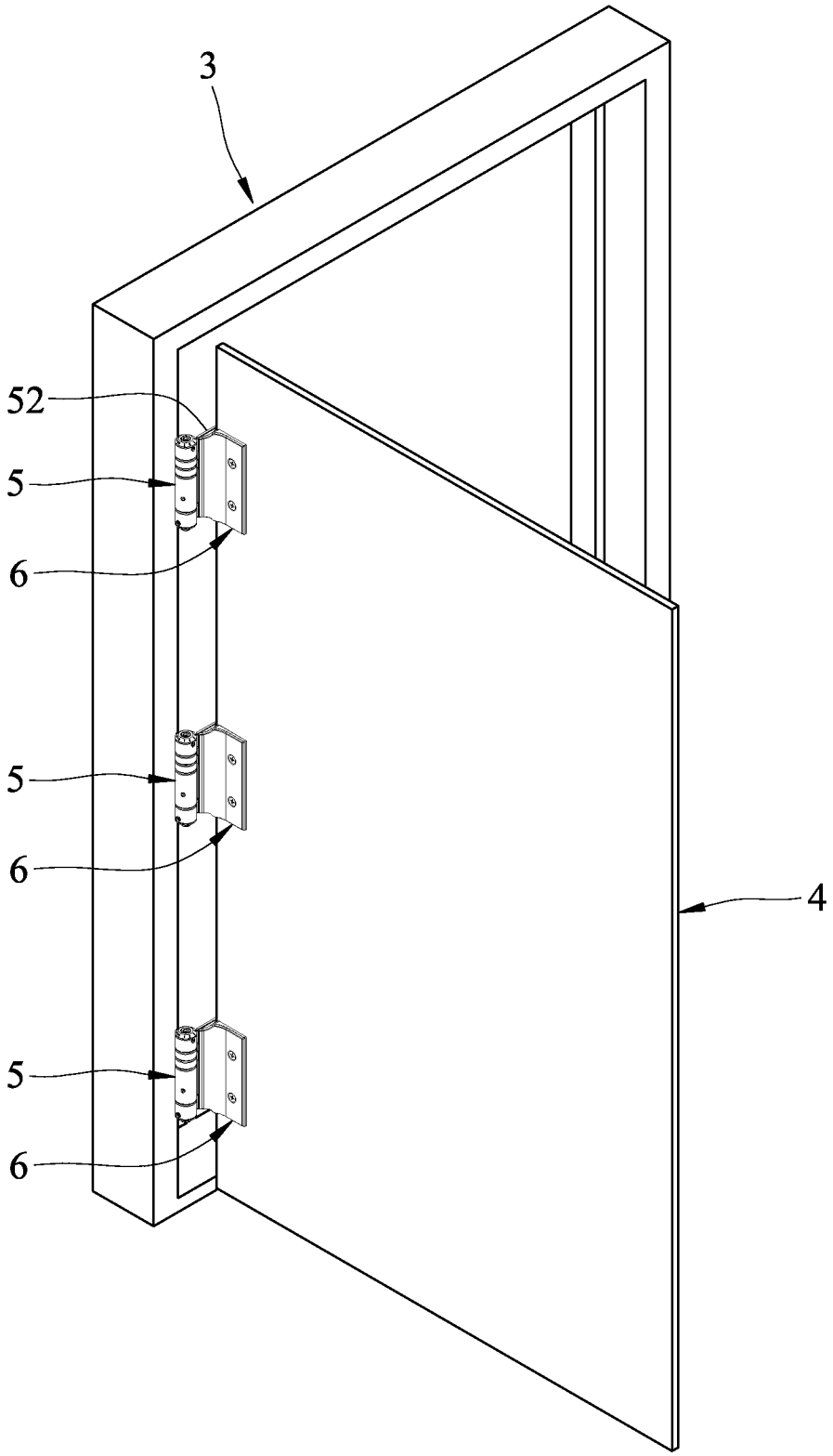
FIG. 4 is a perspective view of an embodiment of a hinge device according to the disclosure when mounted on a door.
Figure 5:
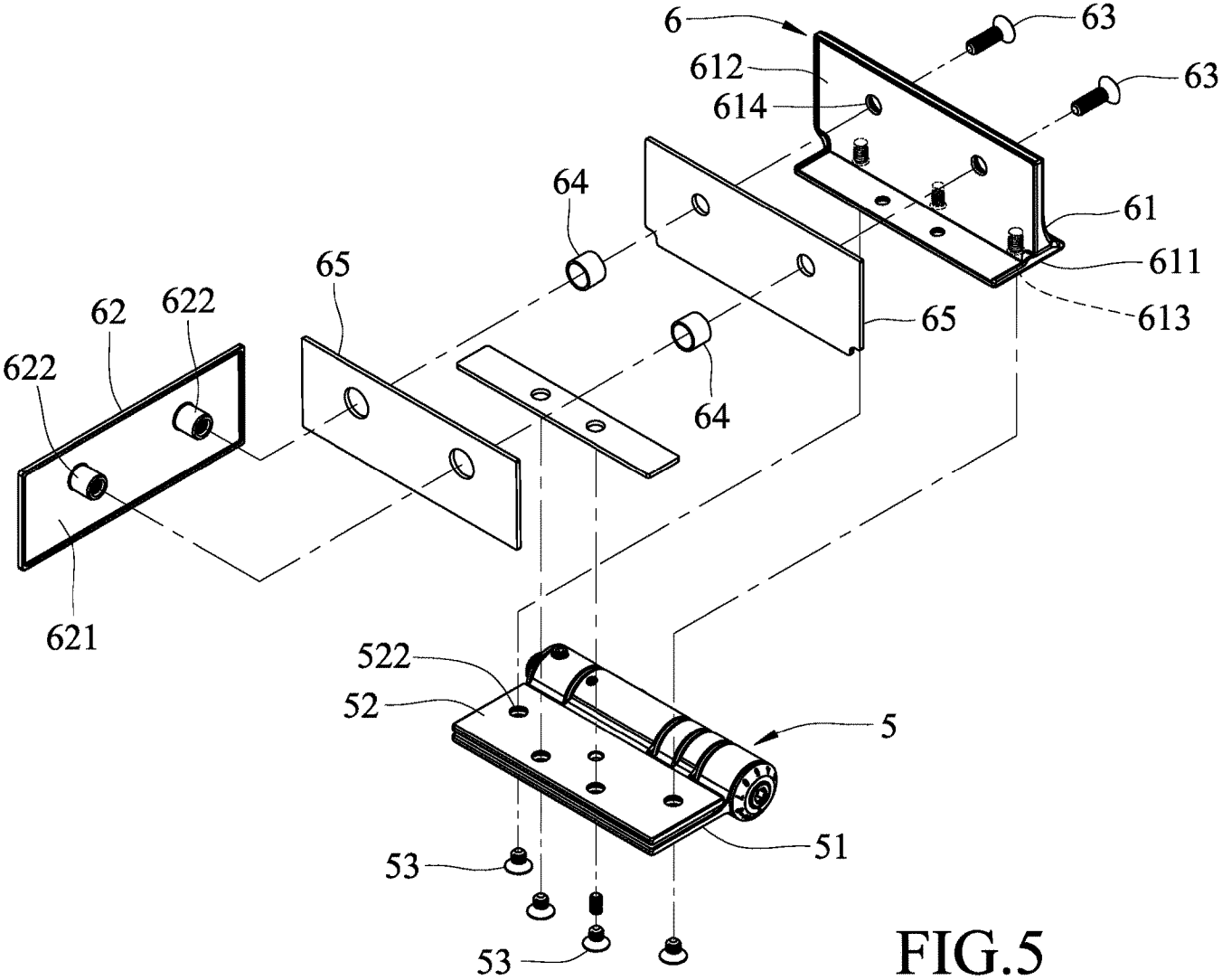
FIG. 5 is an exploded perspective view of the embodiment.
Figure 6:
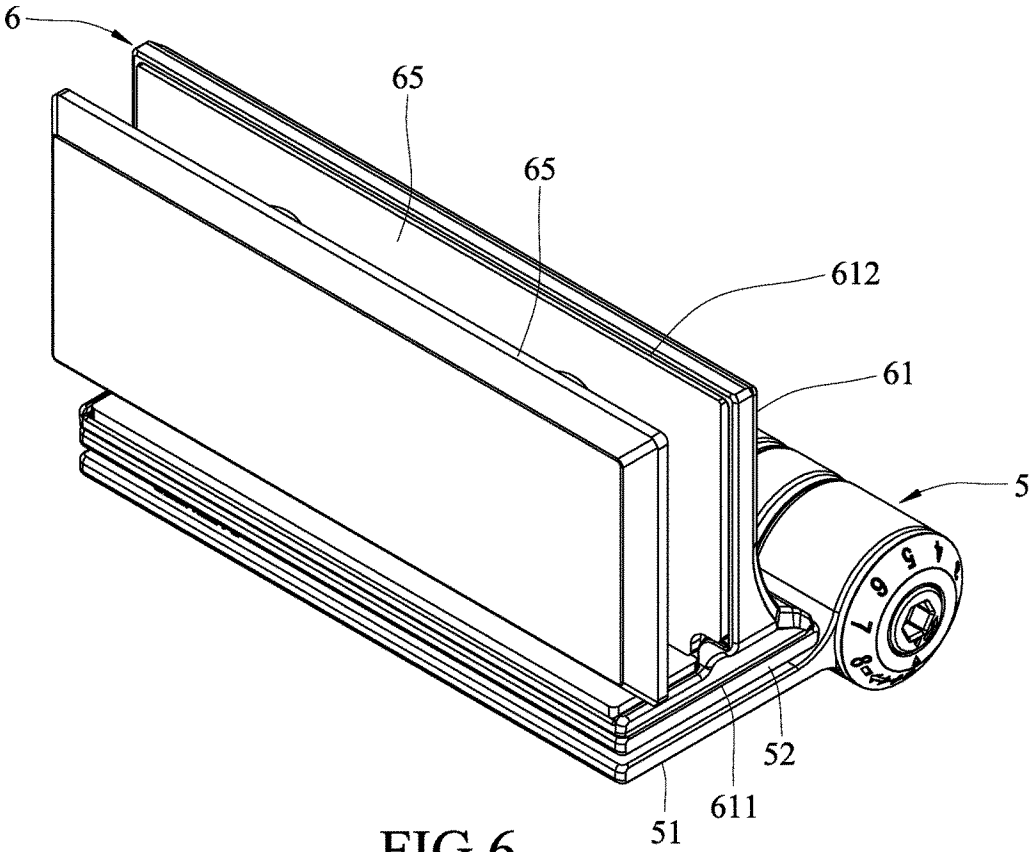
FIG. 6 is a perspective view of the embodiment.
Figure 7:
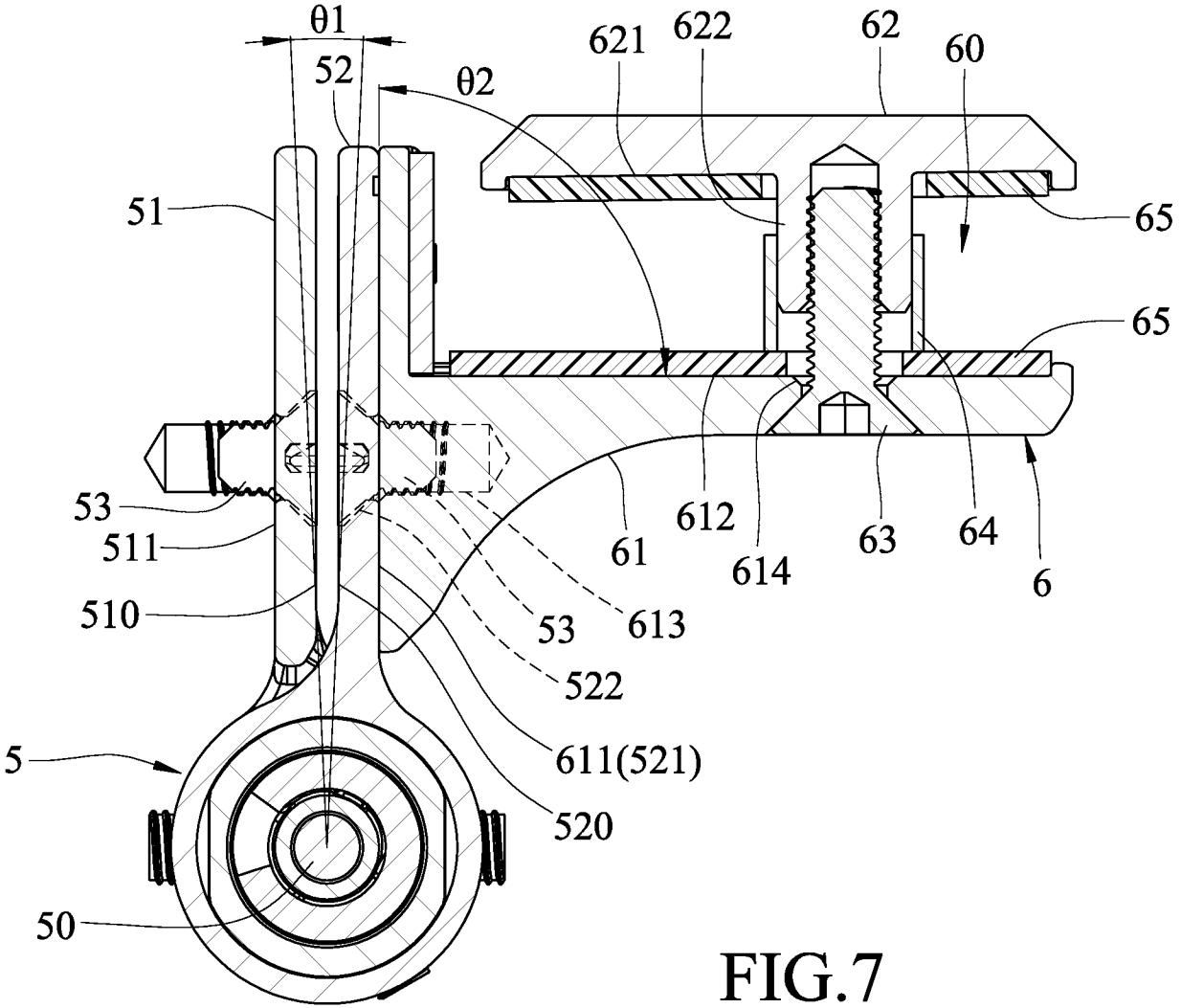
FIG. 7 is a sectional view of the embodiment.

Referring to FIG. 4, an embodiment of a hinge device according to the disclosure is adapted to interconnect a first object 3 and a second object 4 to allow rotation relative to each other. In this embodiment, the first object 3 is a door frame. The second object 4 may be a wood-made door or a glass door. With reference to FIGS. 5 to 7, the hinge device includes a hinge 5 and a clamping unit 6.

The hinge 5 includes a first leaf 51 which is adapted to be mounted on the first object 3, and a second leaf 52 which is pivotably connected to the first leaf 51 by an axle 50 about an axis and which is adapted to be mounted on the second object 4 when the second leaf 52 is in a first mounting position (a detailed description will be provided hereinafter), and a plurality of first screws 53. The first leaf 51 and the second leaf 52 respectively have included surfaces 510, 520 which respectively define extending lines that meet at the axis to have therebetween a first angle (81) ranging from 0 degree to 180 degrees, and attaching surfaces 511, 521 which are disposed opposite to the included surfaces 510, 520, respectively, and remote from each other. In this embodiment, the second leaf 52 has a plurality of through holes 522 extending from the included surface 520 to the attaching surface 521.

The clamping unit 6 includes a bracing plate 61 and a pressure plate 62 which are spaced apart from each other by a clamping space 60 for accommodating the second object 4 when the second leaf 52 is in a second mounting position (a detailed description will be provided hereinafter), a plurality of second screws 63, a plurality of guiding sleeves 64 and a plurality of gasket paddings 65.

In this embodiment, the bracing plate 61 is removably connected to the second leaf 52, and is generally L-shaped. The bracing plate 61 has an attached surface 611 which is configured to be attached to the attaching surface 521 of the second leaf 52, and a bracing surface 612 which faces the clamping space 60. The attached surface 611 and the bracing surface 612 respectively define extending lines that meet at the attached surface 611 to have therebetween a fixed second angle (62). The fixed second angle (02) is not less than 90 degrees, and may be 90 degrees in this embodiment. In this embodiment, the bracing plate 61 has a plurality of screw holes 613 extending from the attached surface 611 and aligned with the through holes 522, respectively, when the attached surface 611 is attached to the attaching surface 521. The bracing plate 61 further has a plurality of through holes 614 (two through holes 614 in this embodiment) extending through the bracing surface 612.

The pressure plate 62 has a pressure surface 621 which faces the clamping space 60, and a plurality of screw sockets 622 (two screw sockets 622 in this embodiment) which extend from the pressure surface 621 toward the bracing surface 612.

In this embodiment, the clamping unit 6 includes two of the second screws 63. Each second screw 63 is disposed to extend through the respective through hole 614 and the second object 4 to be screwed into the respective screw socket 622 of the pressure plate 62.

In this embodiment, the clamping unit 6 includes two of the guiding sleeves 64. Each guiding sleeve 64 is configured to be fitted in the second object 4, and has an inner sleeve surface that is configured to be sleeved on the respective screw socket 622 to guide screw-in engagement of the second screw 63 in the screw socket 622.

One of the gasket paddings 65 is disposed between the bracing surface 612 and the second object 4. The other one of the gasket paddings 65 is disposed between the pressure surface 621 and the second object 4.

Figure 8:
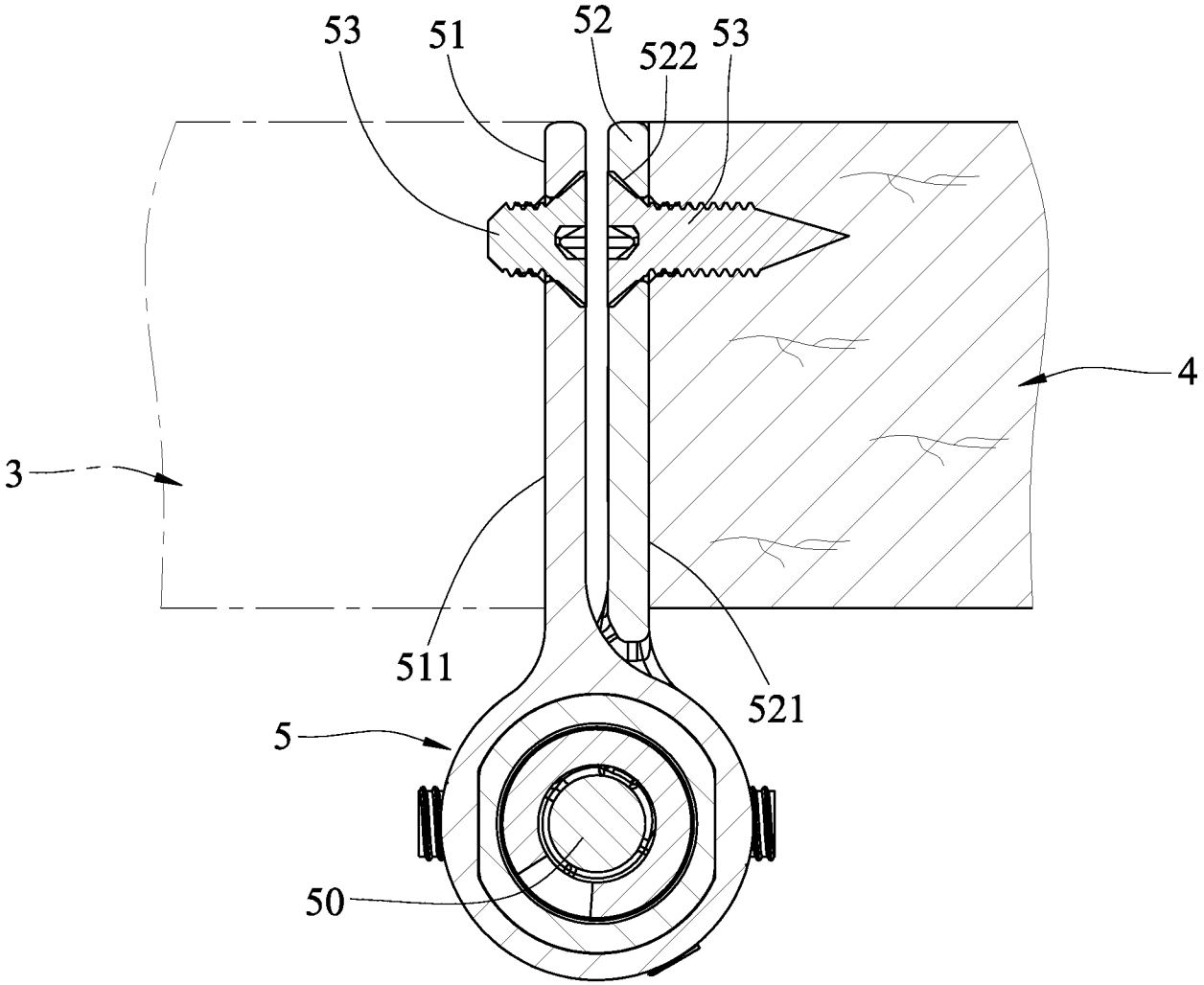
FIG. 8 is a schematic sectional view illustrating the embodiment in a first mounting state where a second leaf is mounted on a wood-made door.

The hinge 5 may be mounted in two mounting states. As shown in FIG. 8, in the first mounting state, the second object 4 is a wood-made door, for example. The attaching surface 511 of the first leaf 51 is attached to the first object 3 and secured thereon by the first screws 53. The bracing plate 61 is removed from the second leaf 52 to permit the second object 4 to abut against the attaching surface 521 of the second leaf 52 to place the second leaf 52 in the first mounting position. The first screws 53 are disposed to extend through the through holes 522 of the second leaf 52 to be screwed to the second object 4 such that the second object 4 is connected directly to the second leaf 52.

Figure 9:
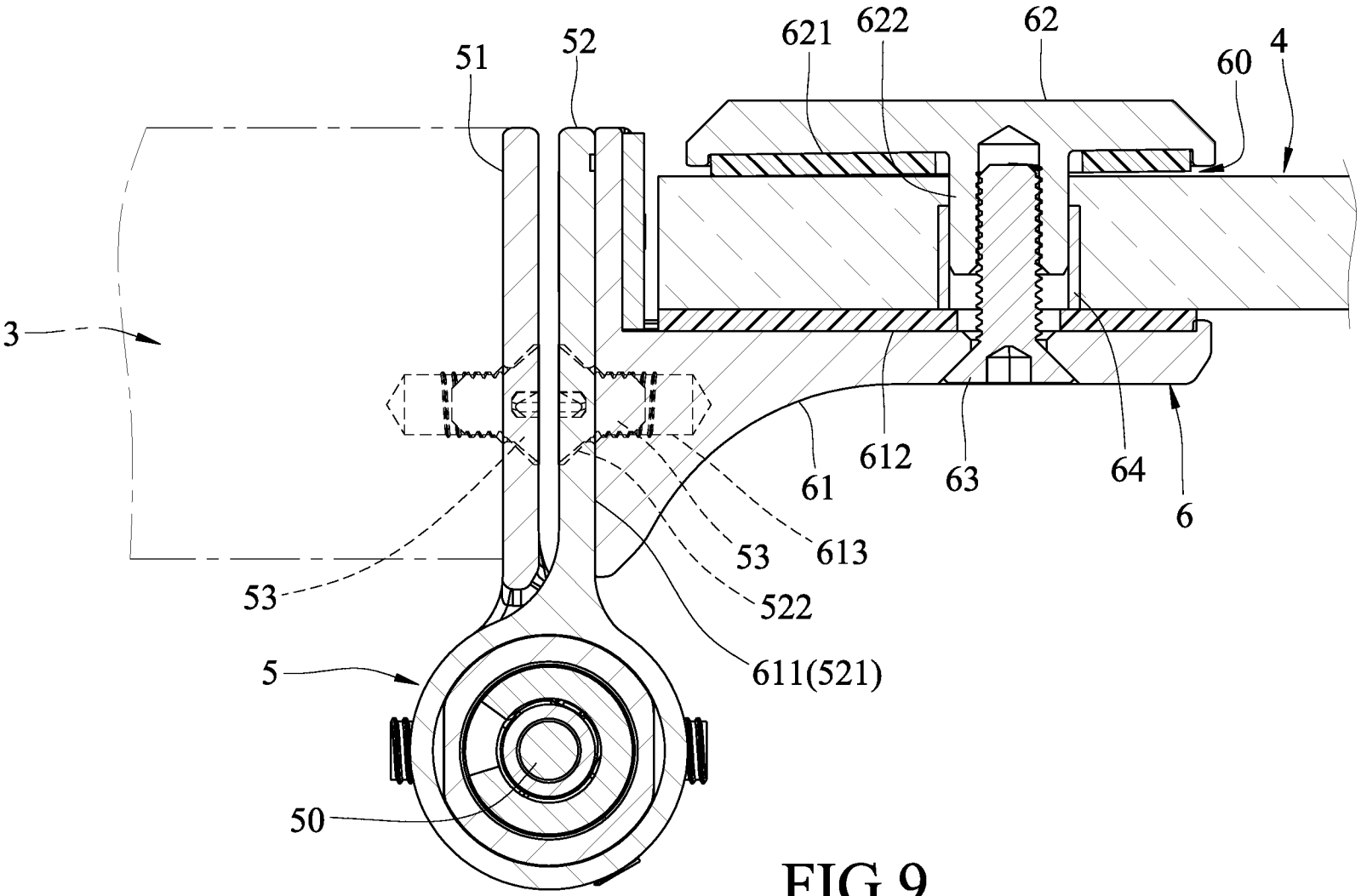
FIG. 9 is a schematic sectional view illustrating the embodiment in a second mounting state where the second leaf is mounted on a glass door.

As shown in FIG. 9, in the second mounting state, the second object 4 is a glass door, for example. The attached surface 611 of the bracing plate 61 is attached to the attaching surface 521 of the second leaf 52 such that the first screws 53 extend through the through holes 522 of the second leaf 52 to be screwed into the screw holes 613 of the bracing plate 61 so as to place the second leaf 52 in the second mounting position. Subsequently, the second object 4 is accommodated in the clamping space 60, and the guiding sleeves 64 are fitted in the second object 4 and are sleeved on the screw sockets 622. Finally, the second screws 63 extend through the bracing surface 612 and the second object 4 to be screwed into the screw sockets 622 of the pressure plate 62 so as to clamp firmly the second object 4 between the bracing and pressure plates 61, 62.

Accordingly, the hinge 5 can cooperate with the clamping unit 6 to be mounted on the glass-made second object 4. In a variation of the embodiment, the clamping unit 6 may be connected to the first leaf 51 for suiting a different requirement.

Figure 10:
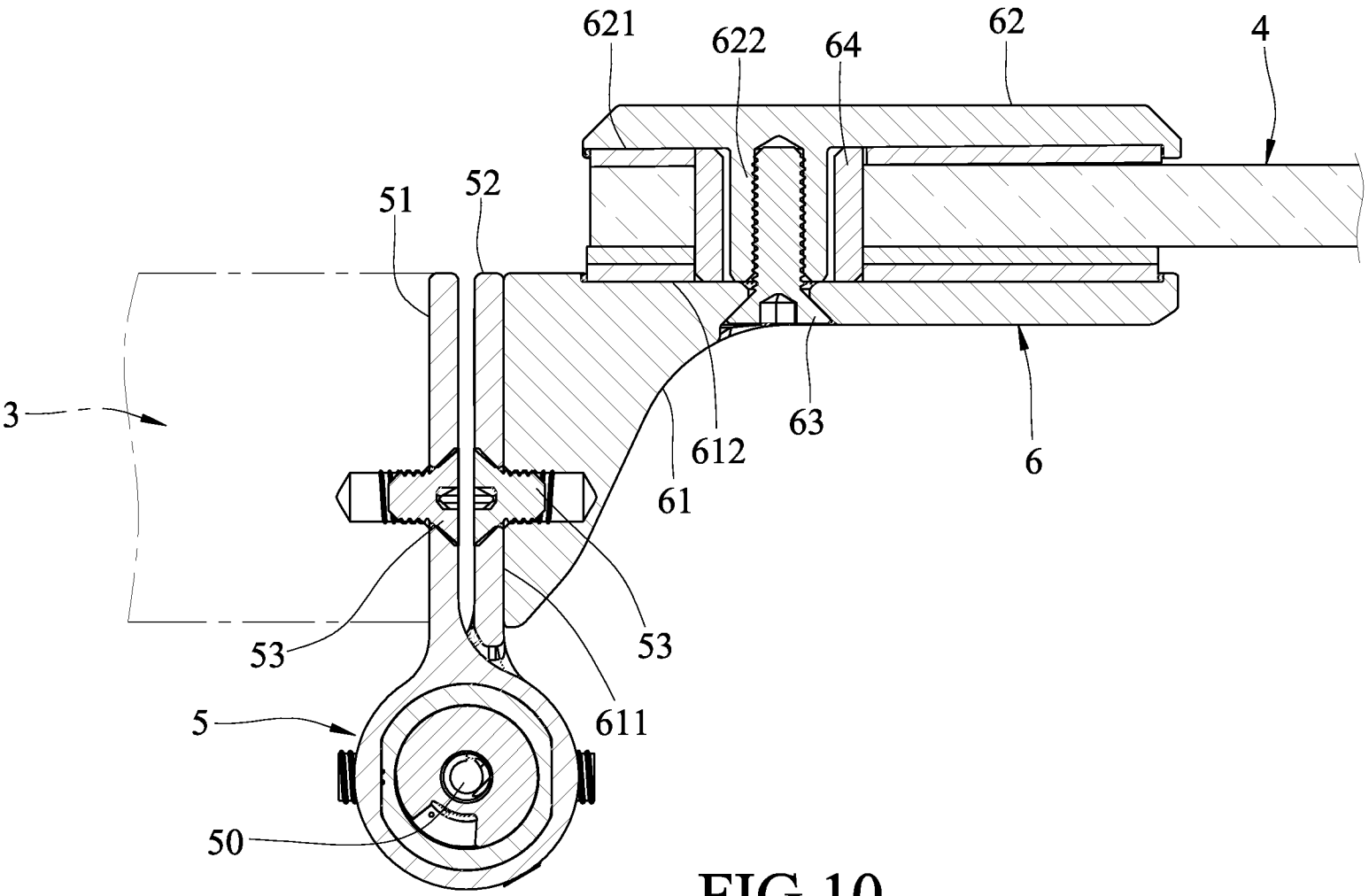
FIG. 10 is a schematic sectional view of another embodiment of a hinge device according to the disclosure.

Referring to FIG. 10, alternatively, in another embodiment, the attached surface 611 of the bracing plate 61 is adjoined with the bracing surface 612.

Figure 11:
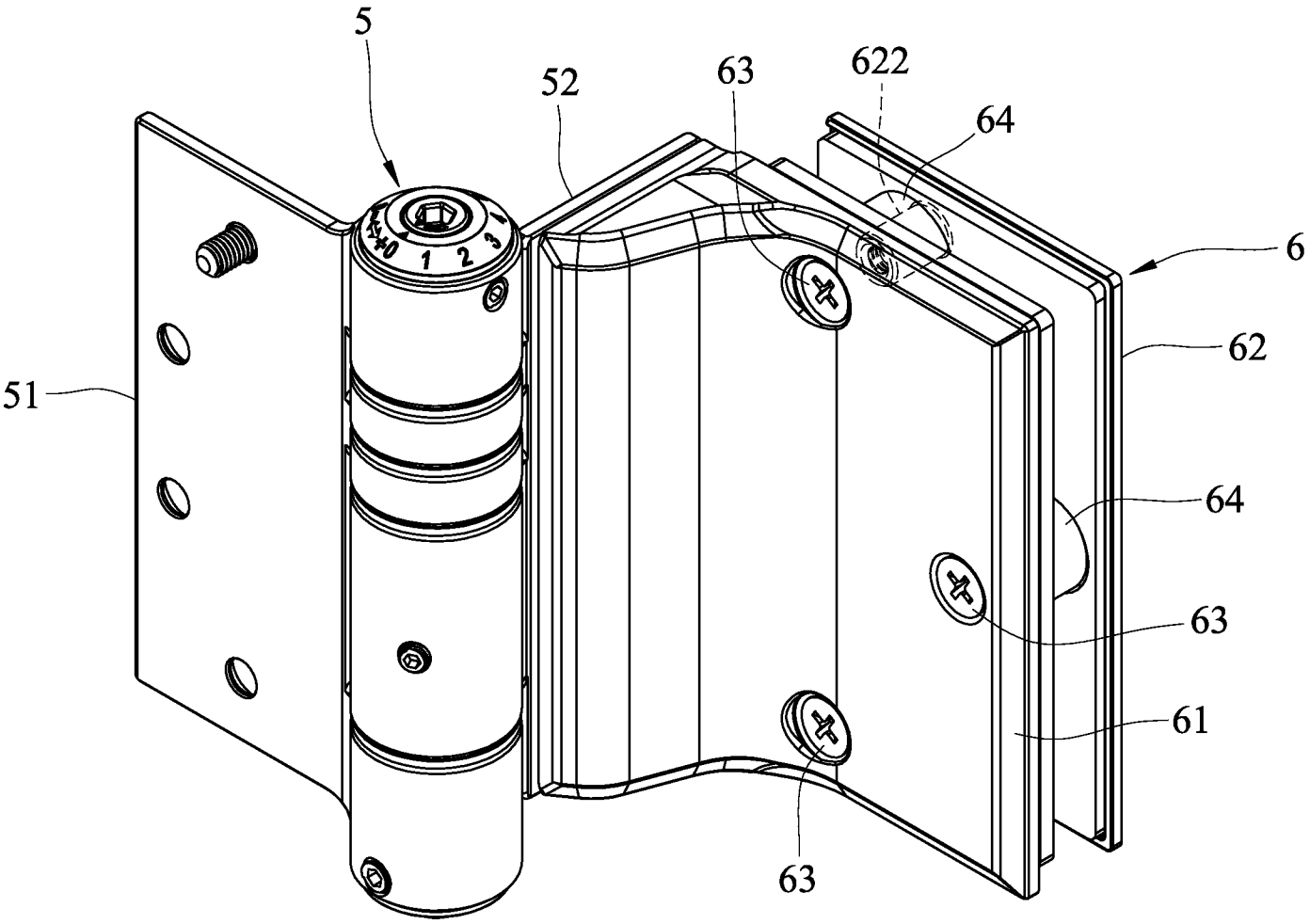
FIG. 11 is a schematic sectional view of a still another embodiment of a hinge device according to the disclosure.

Referring to FIG. 11, alternatively, in a still another embodiment, the clamping unit 6 includes three second screws 63 and three guiding sleeves 64, and the pressure plate 62 has three screw sockets 622 so as to enhance firmness and stability of the second object 4.

As illustrated, with the clamping unit 6 including the bracing and pressure plates 61, 62, the hinge device of this disclosure can be mounted in different ways for applications to different types of doors. Specifically, when a glass door is required to be replaced by a wood-made door, there is no need to replace or disassemble the hinge 5, which results in easy assembly and low cost.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A hinge device for interconnecting a first object and a second object to allow rotation relative to each other, comprising:

a hinge including a first leaf which is adapted to be mounted on the first object, and a second leaf which is pivotably connected to said first leaf about an axis and which is adapted to be mounted on the second object when said second leaf is in a first mounting position, said first leaf and said second leaf respectively having included surfaces which respectively define extending lines that meet at the axis to have therebetween a first angle ranging from 0 degree to 180 degrees, and attaching surfaces which are disposed opposite to said included surfaces, respectively, and remote from each other;

a clamping unit including a bracing plate and a pressure plate which are spaced apart from each other by a clamping space for accommodating the second object when said second leaf is in a second mounting position, said bracing plate being removably connected to said second leaf, and having an attached surface which is attached to said attaching surface of said second leaf, and a bracing surface which faces said clamping space, said attached surface and said bracing surface respectively defining extending lines that meet at said attached surface to have therebetween a fixed second angle.

2. The hinge device as claimed in claim 1, wherein said clamping unit further includes a gasket padding disposed between said bracing surface and the second object, wherein the second object is made from a glass material.

3. The hinge device as claimed in claim 1, wherein said clamping unit further includes a gasket padding disposed between said pressure plate and the second object, wherein the second object is made from a glass material.

4. The hinge device as claimed in claim 1, wherein said second leaf has a plurality of through holes extending from said included surface to said attaching surface, said hinge further including a plurality of first screws which are disposed to extend through said through holes to be screwed to the second object when said second leaf is in the first mounting position.

5. The hinge device as claimed in claim 1, wherein said second leaf has a plurality of through holes extending from said included surface to said attaching surface, said bracing plate having a plurality of screw holes which extend from said attached surface, said hinge further including a plurality of first screws which are disposed to extend through said through holes to be screwed into said screw holes when said second leaf is in the second mounting position.

6. The hinge device as claimed in claim 5, wherein said bracing plate has a plurality of through holes extending through said bracing surface, said clamping unit further including a plurality of second screws which are disposed to extend through said through holes and the second object to be screwed to said pressure plate.

7. The hinge device as claimed in claim 6, wherein said pressure plate has a pressure surface which faces said clamping space, and a plurality of screw sockets which extend from said pressure surface toward said bracing surface and which are configured to be inserted into the second object when the second object is accommodated in said clamping space, said second screws being disposed to be screwed into said screw sockets, respectively.

8. The hinge device as claimed in claim 7, wherein said clamping unit further includes a plurality of guiding sleeves which are configured to be fitted in the second object and each of which has an inner sleeve surface that is sleeved on a respective one of said screw sockets to guide screw-in engagement of said second screws in said screw sockets.

9. The hinge device as claimed in claim 1, wherein the fixed second angle is not less than 90 degrees.

* * * * *